United States Patent [19]

Bottiau

[11] Patent Number: 4,754,966

[45] Date of Patent: Jul. 5, 1988

[54] CIRCUIT FOR FORMING OBJECTS IN A VIDEO PICTURE

[75] Inventor: Michel Bottiau, Maurepas, France

[73] Assignee: U.S. Philips Corp., New York, N.Y.

[21] Appl. No.: 909,065

[22] Filed: Sep. 16, 1986

Related U.S. Application Data

[63] Continuation of Ser. No. 662,864, Oct. 19, 1984, abandoned.

[30] Foreign Application Priority Data

Oct. 19, 1983 [FR] France ..... 83 16637

[51] Int. Cl.[4] ..... A63F 9/22

[52] U.S. Cl. ..... 273/1 E; 273/DIG. 28; 340/720

[58] Field of Search ..... 273/1 E, 85 G, DIG. 28; 340/720, 723–725

[56] References Cited

U.S. PATENT DOCUMENTS 4,116,444 9/1978 Mayer et al. ..... 273/DIG. 28

4,498,079 2/1985 Ghosh et al. ..... 273/85 G

*Primary Examiner*—Maryann Lastova

*Attorney, Agent, or Firm*—David R. Treacy

[57] ABSTRACT

A circuit for generating a plurality of moving or fixed objects on a video screen, more specifically for a video game. The circuit uses a topological memory 20 which represents the picture element by element, and an object memory 31 in which objects are defined by consecutive line segments. The addresses of the line segments are sequentially loaded into the topological memory. A picture generator 26 scans the contents of the object memory 31, under control of the topological memory 20, to define at each instant the colors to be displayed on the screen. Updating the topological memory every field with new line segment addresses changes the display positions of the objects every field thus giving motion to the objects.

8 Claims, 2 Drawing Sheets

CIRCUIT FOR FORMING OBJECTS IN A VIDEO PICTURE

This is a continuation of application Ser. No. 662,864, filed Oct. 19, 1984, now abandoned.

The present invention relates to an circuit for generating objects in a video picture. Each object is represented by a plurality of superjacent segments, each segment coinciding with a line of the image.

The invention relates more specifically to an circuit for generating a plurality of moving objects on a video display screen, for example for a video game, in which with the aid of a microprocessor the position of the objects can be changed by changing the content of the memory.

To position the image of a movable object in a television picture field the prior art video generators compare the X and Y coordinates of a first point which is characteristic of the moving object, with the content of counters which track the position of the spot on the television screen. Such a method is described in, for example, the U.S. Pat. No. 4,116,444. Each picture line is checked for the presence of an object by a subtracting or comparator circuit, while scanning the entire content of a memory in which the coordinates of the objects are stored.

However, the range of applications of such a circuit is very limited as it requires very fast circuits therefor. During display of the picture, a large number of coordinates and arithmetic comparisons must be effected, which limits the number of different objects which can be displayed simultaneously. The arrangement described in the above-mentioned U.S. patent provides an improvement as each line of an image is stored in what is called a "horizontal memory". However, before a line of the image is written into this memory it must be completely updated during a time interval equal to the duration of a line retrace period.

It has also been proposed to use a memory which comprises the complete content of the picture.

The U.S. Pat. No. 4,165,072 describes such a solution. The patent indicates (column 3, last paragraph) that such a structure is ideal for those circumstances in which the video signal can assume only two discrete values because a memory can only record one out of two discrete signal levels. The patent states, however, that doubling the memory volume permits four signal levels and tripling the memory permits eight signal levels to be recorded etc. So in the case of a color video signal, and with only four bits for the color definition, such a solution would require a memory having 256K octets for storing a picture of 256×256 picture elements which is prohibitive.

SUMMARY OF THE INVENTION

The invention has for its object processing a large number of objects for display simultaneously.

The invention for carrying out this object comprises:

a topological memory for storing a data group for each picture line on which a segment of an object is present, the data group indicating the beginning position of that segment on that picture line and an identification number of that object;

an object memory for storing data streams, each data stream defining a segment of a specific object;

an address register which indicates at which address a predetermined segment of a given object has been stored in the object memory and the location in the picture where this segment must be displayed; and, means for reading and addressing the topological memory and for reading the address register each time the object number of an object is met during reading of the topological memory to produce the desired line segment for display.

The invention will now be described by way of example in greater detail with reference to the accompanying drawings.

DESCRIPTION OF THE PREFERRED EMBODIMENT

As used herein "object" is understood to mean the whole assembly of picture elements or "pixels" from which the image of an object is assembled, when it is displayed on a picture tube. Such an object is formed by a sequence of "object segments". A segment is formed by one or more sequences of pixels located adjacent each other on a television line. In such a sequence each pixel might be fully described individually by each individual pixel color and luminance indicated by means of a code word. It is, however, advantageous in the event of a sequence of identical pixels (that is to say pixels having the same colors and the same luminance to describe the entire sequence by means of one single code word. The code words describing the object segments are stored in consecutive addresses in a memory denoted the "object memory".

The mode of operation of the system is based on the use of a topological memory connected to said object memory and formed by a large number of one-bit memory locations. A pixel of the image corresponds to each memory location of this topological memory. A code word for each line of the image on which a segment of an object is present is stored in this topological memory. This code word comprises an identification number for this object and a position code word indicating the difference between the number of the pixel corresponding to the first pixel of the segment, and the number of the memory location in which the first bit of the code word is stored. The content of the topological memory is scanned in synchronism with scanning of the pixels of the image. If it is ascertained that the beginning of a segment is involved, then that portion of the object memory is scanned in which the code words describing the relevant segments are stored. Thereafter scanning of the topological memory is continued, starting at a memory location which corresponds to the number of the pixel which immediately follows the last pixel of the scanned segment.

Let it be assumed that each picture is assembled from 256 lines, each having 256 pixels, 220 of which are visible.

Figure 1:
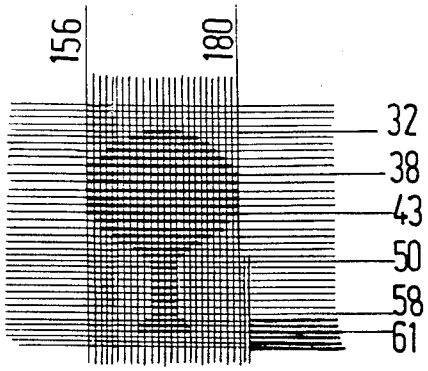
FIG. 1 shows in a television raster an object to be displayed.

FIG. 1 shows the pixels which together represent a tree. This tree has a maximum width of 24 pixels and a height of 30 lines. The top of this tree is located at line 32 and its base at line 61 and, the outermost left-hand side in column 156. The first segment of this tree is located at line 32. It starts with 9 "transparent" pixels, followed by 6 coloured pixels, for example green pixels.

The segment ends after these 6 green pixels. The segment of this tree which coincides with line 38 consists of only 24 green pixels. Thus, all segments begin in column 156. A "transparent" pixel means that a pixel of a different object to be displayed in the same position has priority over this pixel, and irrespective of other priorities. The segments coinciding with the lines 38 to 43, inclusive are identical to each other. This implicates that such a segment should be stored 6 times in the object memory. It is, however, possible to have this segment appear only one single time. This requires however that the topological memory must be provided with the ability to indicate that a predetermined segment must be used several times for the display of the object. This also applies to the segments coinciding with the lines 50 to 58 and for the two segments coinciding with the lines 60, 61. The code words describing these segments each occur once in the object memory, and a multiple display of these segments is indicated in the topological memory. To that end each code word in the topological memory comprises a so-called repetition bit, which if it is, for example, in the "1" state, indicates that when the same object number is met again during scanning of the topological memory the segment previously displayed must be displayed again.

Figure 2:
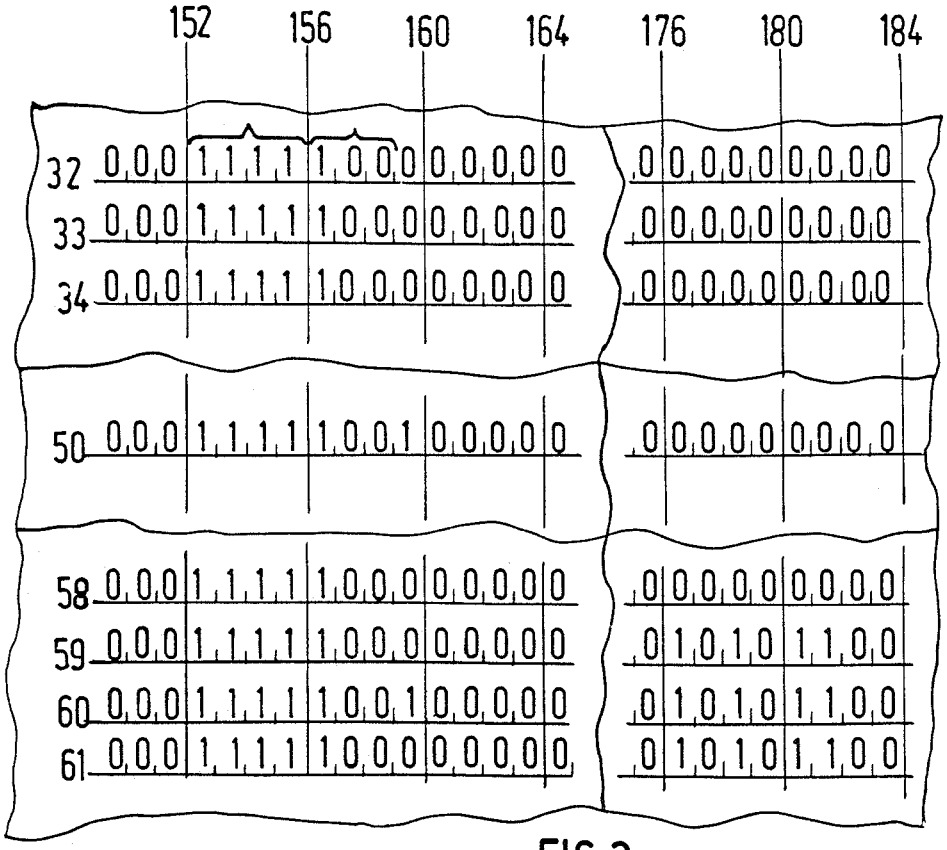
FIG. 2 shows schematically the content of a portion of the topological memory.

FIG. 2 shows the portions of a topological memory in which the data groups are stored which indicate the beginning of the segments from which the tree of FIG. 1 is assembled. These data groups are stored in predetermined memory locations in accordance with the position of a regular raster. Such a data group comprises an object number and a position code word and has a total length of eight bits. The first bit of the data groups characterizing the segments of the tree shown in FIG. 1 are not stored in the memory locations located in column number 156, but in the memory locations located in column number 152, the reasons being that 156 is not divisable by 8 but 152 is. The four first bits "1111" represent the object number (in this case 15). There can only be 15 objects (and not 16) as the code "0000" means "no object" and not "object number zero".

The three consecutive bits "100" represent the position code word (in this case the number 4). It indicates that the segment begins with the pixel located in column number 152+4=156. The last bit 0 indicates that this segment will not be repeated.

The object number (15) and the position "156" are equal for all segments of this object, so that for all the thirty lines of the height of this object the same octet is present in the topological memory, the line 38 to 42, 50 to 56, and 60 excepted, for which the last bit has the value 1.

The memory locations in column 180, which correspond to the end of the object contain a zero which means that from that moment all the pixels are transparent again.

The octets "10101100" in the lines 59 and 60 indicate the beginning of a new object having the number 10 and starting at line 59 in column 182.

The memory is controlled by a microprocessor and with the aid thereof the positions of the objects are changed by changing the content of the memories. This change is effected during the field retrace period. The microprocessor controls an automatic device which orders the number of the objects and the position code word in accordance with a predetermined format and writes them into the topological memory.

Moving an object only causes changes in the topological memory. This change consists of two steps:
a memory clearing step
a write step.

To clear the topological memory the microprocessor must apply the following instructions to the automatic device:
"clear" 1 bit
plane number 1 bit
$X_o$-coordinate 8 bits
$Y_o$-coordinate 8 bits
height of the object 8 bits The automatic device then automatically carries out the clearing operation.

To write the memory, the microprocessor applies the following instructions to the automatic device:
"write" 1 bit
number of the object 4 bits
repetition bit 1 bit
X- and Y-coordinates 2 octets.

If the object has a height equal to n lines, then n clearing cycles and n writing cycles will be necessary, so a total of twice n cycles.

The microprocessor can alternatively apply the following data in one run to the automatic device:
$X_o$, $Y_o$, X, Y
object number, plane number
height of the object.

The time required for performing this clear-write cycle is of the order of magnitude of 0.8 μs per line. Replacing a complete background, for example a football field, requires approximately 250 μs. Moving an object having a height of thirty lines then requires approximately 52 μs. The field retrace period of approximately 2 mS renders it possible to move a large number of objects.

In the object memory each sequence of bits describing a segment is distributed into blocks all having the same length. Each sequence has at least one address block with the address of the sequence of bits describing the subsequent segment, and at least a "picture element block".

Figure 3:
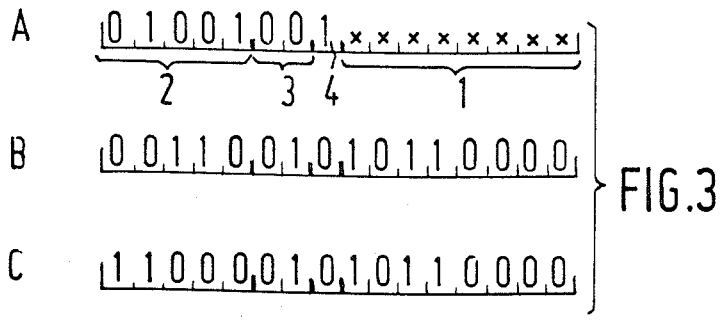
FIG. 3 shows schematically the contents of the object memory.

FIG. 3A shows a possible construction of a picture element block in the object memory.

Such a block comprises two octets: the colour octet 1 with the aid of which 256 colours can be defined and a service octet. This service octet comprises a five-bit code word 2 indicating the number of pixels in a group of pixels, and two surface bits 3 indicating the character of that group of pixels. More specifically, the code 00 then indicates that a normal sequence code is involved, 01 indicates that the group of pixels represents the last pixels of the segment, code 10 indicates that the group of pixels represent the last pixels of the object, whilst code 11 indicates that the two subsequent octets of the object must be skipped. In addition, a transparency bit 4 which by means of a "1" indicates that the group of pixels is transparent is also available.

The octets shown in FIG. 3*a* define the nine transparent pixels of the first line of the tree shown in FIG. 1. In FIG. 3B the two octets are shown which define the six subsequent pixels, the code "10110000" representing, for example, the desired green colour.

FIG. 3C shows the two octets by means of which line 38 is defined.

The two first octets required to define a segment do not define the number of pixels in a group of pixels but furnish the starting address of the subsequent segment of the same object. This is of special use for the case in which a segment which is being displayed would be interrupted prematurely by a line retrace.

A possible bit construction of a whole segment is shown in FIG. 3D. It starts with the address 14 of the subsequent segment of the object, followed by a given number of picture element blocks (15, 17, 170, 19) between which other addresses are positioned (16, 18), whose function will be explained hereinafter.

The service bits 3 of the picture element block immediately preceding such an interposed address block define a skip, this address block being skipped in normal circumstances. The last picture element block comprises service bits 3, defining "end-of-segment". Except for the case in which an address block is positioned between two consecutive picture blocks the picture element blocks of the segment are stored at consecutive addresses in the object memory.

In order to find in the object memory the segments found during reading of the topological memory, which segments are identified by an object number, an address register is provided connected to the topological memory. In the address register the starting and final addresses of an object are recorded in the object memory, for each object in a position which corresponds to the number of that object. This address register consists of two parts. One part P, contains for each object number the so-called beginning-of-object address, which indicates at which address the relevant object in the object memory begins. The other part, $P_o$, contains for each object number a so-called starting address which indicates in which position in the image a predetermined segment of this object must be displayed. This starting address changes from segment to segment.

Let it, for example, be assumed that an object to be displayed is stored in the object memory having a starting address AD.

Let it be assumed that PL is the plane in which this object is to be positioned and N the number of this object (object number) in that plane. The address AD is then written into the position N in the part $P_o$ and into the part P of the address register.

The beginning-of-object address part P therefore comprises at each instant the 15 starting addresses of the 15 data streams which each define an object. The starting address part $P_o$ comprises the address of the segment being displayed or of the subsequent segment. During updating, during the field retrace period, the part P is transcribed in the part $P_o$. Each time a new object number is found in a line, the address of the segment to be displayed is read in the part $P_o$ of the address register. If the repetition bit has the value "1", the two address octets which define the beginning of a data stream are skipped. If this bit is not "1", the address containing these two octets is read and recorded in the register $P_o$ in the location of the output address just used. Thereafter the picture element block subsequent to the address block is read. The number of pixels of this group is loaded into a downcounter CP to which the clock applies a pulse each time a new pixel is written by the display spot on the display screen. In a further counter CA the address located in the part $P_o$ is transcribed. This counter preserves at any instant the address of the group of pixels to be displayed. The parts $P_o$ and P each comprise one address per object number, each, for example, 15 addresses, whereas in contrast therewith the counters CP and CA contain only one address and are used alternately by all the objects. When the number of scanned pixels corresponds to the number of pixels of the group, the down-counter CP reaches zero. The zero at the output of the counter CP prevents the address located in the address counter CA from increasing further. Then four cases may occur, depending on the contents of the two service bits:

(1) usual sequence: the address counter CA, whose content has just increased now indicates the address of the subsequent group of pixels, (2) end-of-segment: the address of the subsequent segment is indicated by the counter CA. But this address is useless here since it is already present at the segment heading and has been placed in the column $P_o$.

(3) end-of-object: in that case the starting address is transferred from P to $P_o$.

(4) skip: the address counter CA is now increased by one additional unit.

A particularly important case is the case in which a moving object moves to an edge of the picture, exceeds this edge and disappears from the picture. If the object leaves the picture at the right-hand side, it crosses the edge of the picture and the display of at least certain segments is interrupted by the line retrace. The address then present in the counter CA is then no longer valid. But the address of the start of the subsequent segment is in the part $P_o$. Everything then proceeds as in the event of a segment end. If the object leaves the picture at the bottom this poses no problem as the memories are then updated during the field retrace. If the object leaves the picture at the top the first segments disappear and thereafter one or a few segments more of each subsequent picture. During updating, the microprocessor positions the address of the desired other segment in the begin-of-object address register P instead of the starting address. It detects this address during the field retrace by scanning the object memory.

The most difficult case is the case in which the object disappears from the picture at the left-hand side. As soon as the left-hand limit of the object is no longer present in the picture it is in principle not possible to indicate the presence of a picture with the aid of the topological memory, the reason being that it is precisely this left-hand limit from which the structure of the object is defined. To solve this problem, the topological memory is chosen to have the capacity to store the picture line portions which are not displayed and which are located on the left outside the picture. For large-sized objects this requires a very large object memory capacity, which is not desirable. In order to avoid this, each segment is divided in the object memory into sub-segments each comprising a predetermined number of pixels and the address of the corresponding sub-segment of the subsequent segment is positioned at the beginning of each data stream defining a sub-segment. A band of 32 fictitious picture elements is, for example, reserved to the left of each line in the topological memory and the sub-segments are each chosen to be 32 pixels long.

Displaying the object then starts at the first column of which a portion is visible.

Figure 4:
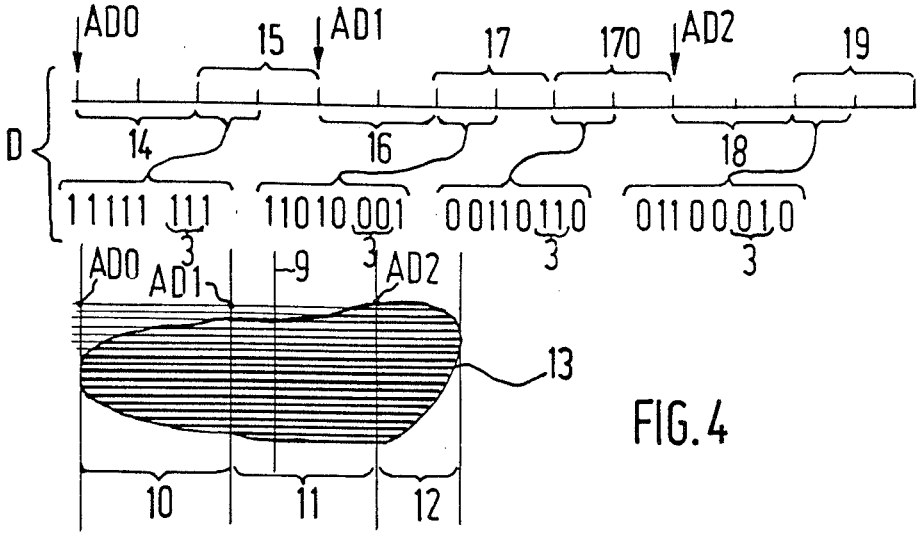
FIG. 4 shows a large-sized object which can leave the picture through the left hand side.

FIG. 4 shows the example of an object 13 which is divided into columns 10, 11, 12, each having a width of 32 pixels, the last column expected. The left edge of the picture is indicated by 9. The column 10 is not used and the address indicated in the part P is the address of the data stream which defines the sub-segment which starts at point AD1. FIG. 3D illustrates this data stream. The address of the subsequent segment is located at 14. At 15 a block of pixels is defined which are located to the left of the point AD1 in FIG. 4, whose service octet is shown in detail. It comprises the bits "11111", which indicates that the sub-subsequent comprises 32 pixels. In addition, it contains the skip code 11 and the transparency bit "1". At 16 the address of the corresponding sub-segment, of the subsequent segment is located, that is to say of the sub-segment located in column 11 of the subsequent line. At 17 the 26 first transparent pixels occurring after the point AD1 of the first line of column 11 are defined, if there is a surface octet the bits contain "11010"=26 pixels; "00"=normal sequence; "1"=transparent. At 170 the 6 remaining pixels of the group of 32 pixels of the first line of column 11 are described, having a service octet containing the bits "00110"=6 pixels; "11"=skip; "0"=not transparent. At 18 the address of the sub-segment is indicated which, in column 12, is located in the subsequent segment and at 19 the last group of pixels of the first segment of the object are defined with a surface octet comprising: the bits "01100"=12 pixels; "01=end-of-segment; "0"=not transparent. The address AD1 between the pair of octets 15 and 16 indicates the address included in the part P during updating of the picture. All this is effected as if the object is a new object less its left-hand column 10.

Figure 5:
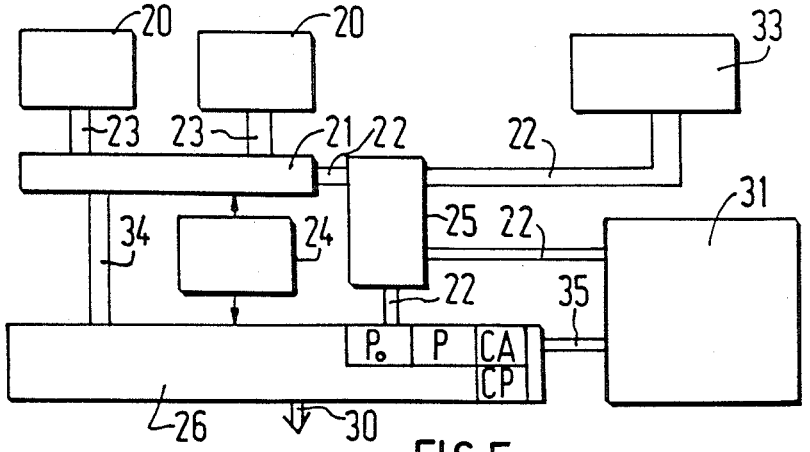
FIG. 5 is a block circuit diagram of an circuit according to the invention.

The arrangement shown in FIG. 5 comprises a topological memory 20 which here consists of two random-access memory blocks, called a "dynamic RAM" memory, having a unit capacity of 16K×4 bits which represent 4 picture areas by using 32K bits per area. In addition, there is provided an object memory 31, consisting of, for example, 8K octets of a fast static RAM-memory. This object memory contains all the objects which can be employed during a period of use and not only those which are displayed at a given instant.

A boundary plane module 21, comprising the said automatic device is connected to the topological memory 20 and to a picture generator module 26 the respective connections 23, 34. On request, a multiplexer circuit 25 connects the connections 22 between the microprocessor and the modules. A service element 24 applies a plurality of service signals to the different modules, such as, for example, clock, line and field synchronization signals. The boundary plane module 21 ensures loading of the memory 20 during the field retrace period and reading the memory during the display. The picture generator 26, which comprises the parts P, $P_o$ and the counters CA, CP ensures the connection 35 that the object memory is read in accordance with the object number indications supplied by the boundary plane module 21, and supplies in real time a connection 30 the instruction of the colour to be displayed.

Having thus described my invention, what is claimed is:

1. A circuit for generating object images in a video picture, said picture being formed by a multiplicity of pixels arranged as a raster scanned in a multiplicity of successive lines, in which the image of each object is presented as a plurality of segments on adjoining lines, comprising:

a topological memory having memory locations corresponding to respective pixels, for storing data groups in respective locations, for each group whose corresponding pixels include a pixel which should be the start of a segment of an object image, said each data group including an identification number for a respective, specific object and the location of the pixel at which the segment starts, an object memory for storing data streams, each data stream defining a segment of a specific object, an address register for storing, with respect to an identified object, the address at which a predetermined segment is stored in the object memory, and the position in the picture where this segment is to be displayed, and means for (a) addressing and reading the topological memory in synchronism with scanning of the raster, (b) reading from the address register the address in the object memory at which data is stored defining the segment to be displayed, each time an object number is read from the topological memory, and (c) reading from the object memory, at the address read from the address register, data defining the said segment to be displayed, whereby movement of a location of an image in the picture requires a change of the data stored in the topological register only.

2. A circuit as claimed in claim 1, wherein the address register includes two parts, one part containing for each object identification number the address which is recorded in the object memory for at least one picture field identifying the beginning segment of said object, the other part containing an output address which corresponds to the description of a segment of the object which is changed each time a new segment, which differs from a segment immediately preceding said new segment, is to be displayed.

3. A circuit as claimed in claim 2, in which the content of at least one memory is changed to change the position of the object images in the picture, during the field retrace period.

4. A circuit as claimed in claim 2, wherein each data group of the topological memory comprises a repetition bit which indicates that the subsequent segment to be displayed of a specific object is the same as the segment previously displayed.

5. A circuit as claimed in claim 1, wherein the heading of each segment data stream in the object memory includes the address of the data stream defining the subsequent segment to be displayed.

6. A circuit as claimed in claim 1, wherein each segment in the object memory is divided into sub-segments, all but the last of said sub-segments having a predetermined constant length, each sub-segment being preceded by the address of a corresponding sub-segment which is located in the subsequent segment to be displayed.

7. A circuit according to claim 6, wherein said topological memory includes a plurality of locations corresponding to picture locations which are to the left and outside of the picture portion which is viewable, and wherein during updating of said picture information only data identifying viewable portions of said object image are entered in the remaining portion of the memory which represents the viewable field of the picture.

8. A circuit for generating object images in a video picture, said picture being formed by a multiplicity of pixels arranged as a raster scanned in a multiplicity of successive lines, in which the image of each object is presented as a plurality of segments on adjoining lines, comprising:

a topological memory having memory locations corresponding to respective pixels, for storing data groups in respective locations, for each group whose corresponding pixels include a pixel which should be the start of a segment of an object image, said each data group being located in a predetermined position in said topological memory, and including an identification number for a respective, specific object and the location of the pixel at which the segment starts, said data group further comprising a series of shift code bits which represent the value of the shift between the actual position of the segments and the position of the data group, an object memory for storing data streams, each data stream defining a segment of a specific object, an address register including two parts for storing, with respect to an identified object, the address at which a predetermined segment is stored in the object memory, and the position in the picture where this segment is to be displayed;

one of said parts containing for each object identification number the address which is recorded in the object memory for at least one picture field identifying the beginning segment of said object, the other part containing an output address which corresponds to the description of a segment of the object which is changed each time a new segment, which differs from a segment immediately preceding said new segment, is to be displayed, and means for (a) addressing and reading the topological memory in synchronism with scanning of the raster, (b) reading from the address register the address in the object memory at which data is stored defining the segment to be displayed, each time an object number is read from the topological memory, and (c) reading from the object memory, at the address read from the address register, data defining the said segment to be displayed, the content of at least one of said memories being changed during the field retrace period, to change the position of the object images in the picture, whereby movement of a location of an object image in the picture requires a change of the data stored in the topological register only.

9. A circuit as claimed in claim 8, wherein the identification number of the object comprises four bits and the value of the shift is represented by four bits.

10. A circuit as claimed in claim 8, comprising a microprocessor for changing the position of the object image by changing at least the content of the topological memory, and an automatic device which loads said object number and said shift code bits in a predetermined format into the topological memory.

11. A circuit as claimed in claim 8, wherein the identification number of the object comprises four bits and, the shift value is represented by three bits.

* * * * *